US008118963B2

(12) United States Patent
Argoitia

(10) Patent No.: US 8,118,963 B2
(45) Date of Patent: Feb. 21, 2012

(54) STAMPING A COATING OF CURED FIELD ALIGNED SPECIAL EFFECT FLAKES AND IMAGE FORMED THEREBY

(76) Inventor: Alberto Argoitia, Santa Rosa, CA (US)

( * ) Notice: Subject to any disclaimer, the term of this patent is extended or adjusted under 35 U.S.C. 154(b) by 379 days.

(21) Appl. No.: 11/769,274

(22) Filed: Jun. 27, 2007

(65) Prior Publication Data

US 2008/0003413 A1 Jan. 3, 2008

Related U.S. Application Data

(60) Continuation-in-part of application No. 11/028,819, filed on Jan. 4, 2005, now Pat. No. 7,300,695, which is a division of application No. 10/243,111, filed on Sep. 13, 2002, now Pat. No. 6,902,807.

(60) Provisional application No. 60/807,103, filed on Jul. 12, 2006.

(51) Int. Cl.
*B42D 15/10* (2006.01)
*B41M 5/025* (2006.01)

(52) U.S. Cl. ..... 156/246; 156/272.2; 264/108; 264/437; 283/72

(58) Field of Classification Search ..... 156/272.2, 156/242, 246; 264/108, 293, 435, 437, 438; 283/72, 82, 83, 94, 113
See application file for complete search history.

(56) References Cited

U.S. PATENT DOCUMENTS

| | | | | |
|---|---|---|---|---|
| 2,570,856 | A | 10/1951 | Pratt et al. | 41/32 |
| 3,011,383 | A | 12/1961 | Sylvester et al. | 359/584 |
| 3,123,490 | A | 3/1964 | Bolomey et al. | 106/291 |
| 3,293,331 | A | 12/1966 | Doherty | 264/1.31 |
| 3,338,730 | A | 8/1967 | Slade et al. | 428/142 |
| 3,610,721 | A | 10/1971 | Abramson et al. | 350/3.5 |
| 3,627,580 | A | 12/1971 | Krall | 117/238 |

(Continued)

FOREIGN PATENT DOCUMENTS

AU 488652 11/1977

(Continued)

OTHER PUBLICATIONS

Dobrowolski et al., "Research on Thin Film Anticounterfeiting Coatings at the National Research Council of Canada", Applied Optics, vol. 28, No. 14, pp. 2702-2717 (Jul. 15, 1989).

(Continued)

*Primary Examiner* — Katarzyna Wyrozebski Lee
*Assistant Examiner* — Scott W Dodds
(74) *Attorney, Agent, or Firm* — Matthew A. Pequignot; Pequignot + Myers LLC

(57) ABSTRACT

A method of forming a security device is disclosed wherein a magnetically aligned pigment coating coated on a first substrate upon a release layer is hot stamped onto another substrate or object. Multiple patches with aligned magnetic flakes can be oriented differently in the form of a patch work or mosaic. For example, a region of stamped aligned flakes having the flakes oriented in a North-South orientation can be stamped onto one region of an object or substrate and another region of stamped same flakes removed from a same substrate can be stamped onto a same object oriented in an E-W orientation. By first aligning and curing flakes onto a releasable substrate, these flakes can be stamped in various shapes and sizes of patches to be adhesively fixed to another substrate or object.

11 Claims, 4 Drawing Sheets

U.S. PATENT DOCUMENTS

| | | | | |
|---|---|---|---|---|
| 3,633,720 | A | 1/1972 | Tyler | 400/105 |
| 3,640,009 | A | 2/1972 | Komiyama | 283/88 |
| 3,676,273 | A | 7/1972 | Graves | 161/3 |
| 3,790,407 | A | 2/1974 | Merten et al. | 428/148 |
| 3,791,864 | A | 2/1974 | Steingroever | 117/238 |
| 3,845,499 | A | 10/1974 | Ballinger | 346/74.3 |
| 3,853,676 | A | 12/1974 | Graves | 161/5 |
| 3,873,975 | A | 3/1975 | Miklos et al. | 360/25 |
| 4,011,009 | A | 3/1977 | Lama et al. | 359/571 |
| 4,054,922 | A | 10/1977 | Fichter | 346/74.3 |
| 4,066,280 | A | 1/1978 | LaCapria | 283/91 |
| 4,099,838 | A | 7/1978 | Cook et al. | 359/537 |
| 4,126,373 | A | 11/1978 | Moraw | 359/2 |
| 4,155,627 | A | 5/1979 | Gale et al. | 359/568 |
| 4,168,983 | A | 9/1979 | Vittands et al. | 106/14.12 |
| 4,197,563 | A | 4/1980 | Michaud | 346/74.3 |
| 4,242,400 | A * | 12/1980 | Smith et al. | 428/201 |
| 4,244,998 | A | 1/1981 | Smith | |
| 4,271,782 | A | 6/1981 | Bate et al. | 118/623 |
| 4,310,180 | A | 1/1982 | Mowry, Jr. et al. | 283/67 |
| 4,310,584 | A | 1/1982 | Cooper et al. | 428/212 |
| 4,398,798 | A | 8/1983 | Krawczak et al. | 359/573 |
| 4,434,010 | A | 2/1984 | Ash | 106/415 |
| 4,543,551 | A | 9/1985 | Petersen | 335/284 |
| 4,657,349 | A | 4/1987 | Labes et al. | 359/296 |
| 4,668,597 | A | 5/1987 | Merchant | 430/22 |
| 4,705,300 | A | 11/1987 | Berning et al. | 283/91 |
| 4,705,356 | A | 11/1987 | Berning et al. | 350/166 |
| 4,721,217 | A | 1/1988 | Phillips et al. | 215/230 |
| 4,756,771 | A | 7/1988 | Brodalla et al. | 148/244 |
| 4,779,898 | A | 10/1988 | Berning et al. | 283/58 |
| 4,788,116 | A | 11/1988 | Hochberg | 430/21 |
| 4,838,648 | A | 6/1989 | Phillips et al. | 359/585 |
| 4,867,793 | A | 9/1989 | Franz et al. | 106/415 |
| 4,867,795 | A * | 9/1989 | Ostertag et al. | 106/459 |
| 4,925,215 | A | 5/1990 | Klaiber | 283/82 |
| 4,930,866 | A | 6/1990 | Berning et al. | 359/589 |
| 4,931,309 | A | 6/1990 | Komatsu et al. | 427/599 |
| 5,002,312 | A | 3/1991 | Phillips et al. | 283/72 |
| 5,009,486 | A | 4/1991 | Dobrowolski et al. | 359/580 |
| 5,037,101 | A | 8/1991 | McNulty | 273/139 |
| 5,059,245 | A * | 10/1991 | Phillips et al. | 106/31.65 |
| 5,079,058 | A | 1/1992 | Tomiyama et al. | 428/40 |
| 5,079,085 | A | 1/1992 | Hashimoto et al. | 428/327 |
| 5,084,351 | A | 1/1992 | Philips et al. | 428/411.1 |
| 5,106,125 | A | 4/1992 | Antes | 283/91 |
| 5,128,779 | A | 7/1992 | Mallik | 359/2 |
| 5,135,812 | A | 8/1992 | Phillips et al. | 428/403 |
| 5,142,383 | A | 8/1992 | Mallik | 359/2 |
| 5,171,363 | A | 12/1992 | Phillips et al. | 106/31.65 |
| 5,177,344 | A | 1/1993 | Pease | 235/449 |
| 5,186,787 | A | 2/1993 | Phillips et al. | 216/36 |
| 5,192,611 | A | 3/1993 | Tomiyama et al. | 428/354 |
| 5,199,744 | A * | 4/1993 | Shenton | 283/91 |
| 5,214,530 | A | 5/1993 | Coombs et al. | 359/359 |
| 5,215,576 | A | 6/1993 | Carrick | 524/425 |
| 5,223,360 | A | 6/1993 | Prengel et al. | 430/39 |
| 5,254,390 | A | 10/1993 | Lu | 428/156 |
| 5,278,590 | A | 1/1994 | Phillips et al. | 359/589 |
| 5,279,657 | A | 1/1994 | Phillips et al. | 106/31.65 |
| 5,339,737 | A | 8/1994 | Lewis et al. | 101/454 |
| 5,364,467 | A | 11/1994 | Schmid et al. | 106/404 |
| 5,364,689 | A | 11/1994 | Kashiwagi et al. | 428/195.1 |
| 5,368,898 | A | 11/1994 | Akedo | 427/510 |
| 5,411,296 | A | 5/1995 | Mallik | 283/86 |
| 5,424,119 | A | 6/1995 | Phillips et al. | 428/328 |
| 5,437,931 | A | 8/1995 | Tsai et al. | 428/446 |
| 5,447,335 | A | 9/1995 | Haslop | 283/91 |
| 5,464,710 | A | 11/1995 | Yang | 430/1 |
| 5,474,814 | A | 12/1995 | Komatsu et al. | 427/549 |
| 5,549,774 | A | 8/1996 | Miekka et al. | 156/209 |
| 5,549,953 | A | 8/1996 | Li | 428/64.1 |
| 5,571,624 | A | 11/1996 | Phillips et al. | 428/403 |
| 5,591,527 | A | 1/1997 | Lu | 428/411.1 |
| 5,613,022 | A | 3/1997 | Odhner et al. | 385/37 |
| 5,624,076 | A | 4/1997 | Miekka et al. | 241/3 |
| RE35,512 | E | 5/1997 | Nowak et al. | 101/454 |
| 5,627,663 | A | 5/1997 | Horan et al. | 359/2 |
| 5,629,068 | A | 5/1997 | Miekka et al. | 428/148 |
| 5,630,877 | A | 5/1997 | Kashiwagi et al. | 118/623 |
| 5,648,165 | A | 7/1997 | Phillips et al. | 428/346 |
| 5,650,248 | A | 7/1997 | Miekka et al. | 430/1 |
| 5,672,410 | A | 9/1997 | Miekka et al. | 428/148 |
| 5,700,550 | A | 12/1997 | Uyama et al. | 428/212 |
| 5,742,411 | A | 4/1998 | Walters | 359/2 |
| 5,744,223 | A | 4/1998 | Abersfelder et al. | 428/206 |
| 5,763,086 | A | 6/1998 | Schmid et al. | 428/404 |
| 5,811,775 | A | 9/1998 | Lee | 235/457 |
| 5,815,292 | A | 9/1998 | Walters | 359/2 |
| 5,838,466 | A | 11/1998 | Mallik | 359/2 |
| 5,856,048 | A | 1/1999 | Tahara et al. | 430/1 |
| 5,858,078 | A | 1/1999 | Andes et al. | 106/437 |
| 5,907,436 | A | 5/1999 | Perry et al. | 359/576 |
| 5,912,767 | A | 6/1999 | Lee | 359/567 |
| 5,981,040 | A | 11/1999 | Rich et al. | 428/209 |
| 5,989,626 | A | 11/1999 | Coombs et al. | 427/162 |
| 5,991,078 | A | 11/1999 | Yoshitake et al. | 359/567 |
| 6,013,370 | A | 1/2000 | Coulter et al. | 428/403 |
| 6,031,457 | A | 2/2000 | Bonkowski et al. | 340/572.1 |
| 6,033,782 | A | 3/2000 | Hubbard et al. | 428/407 |
| 6,043,936 | A | 3/2000 | Large | 359/572 |
| 6,045,230 | A | 4/2000 | Dreyer et al. | 359/529 |
| 6,068,691 | A | 5/2000 | Miekka et al. | 106/403 |
| 6,103,361 | A | 8/2000 | Batzar et al. | 428/323 |
| 6,112,388 | A | 9/2000 | Kimoto et al. | 29/17.3 |
| 6,114,018 | A | 9/2000 | Phillips et al. | 428/200 |
| 6,150,022 | A | 11/2000 | Coulter et al. | 428/403 |
| 6,157,489 | A | 12/2000 | Bradley, Jr. et al. | 359/584 |
| 6,160,046 | A | 12/2000 | Bleikolm et al. | 524/284 |
| 6,168,100 | B1 | 1/2001 | Kato et al. | 241/1 |
| 6,241,858 | B1 | 6/2001 | Phillips et al. | 204/192.15 |
| 6,242,510 | B1 | 6/2001 | Killey | 523/204 |
| 6,243,204 | B1 | 6/2001 | Bradley, Jr. et al. | 359/585 |
| 6,403,169 | B1 | 6/2002 | Hardwick et al. | 427/548 |
| 6,549,131 | B1 | 4/2003 | Cote et al. | 340/572.1 |
| 6,565,770 | B1 * | 5/2003 | Mayer et al. | 252/301.36 |
| 6,586,098 | B1 | 7/2003 | Coulter et al. | 428/403 |
| 6,589,331 | B2 | 7/2003 | Ostertag et al. | 106/460 |
| 6,643,001 | B1 | 11/2003 | Faris | 356/37 |
| 6,649,256 | B1 | 11/2003 | Buczek et al. | 428/323 |
| 6,686,027 | B1 | 2/2004 | Caporaletti et al. | 428/195.1 |
| 6,692,031 | B2 | 2/2004 | McGrew | 283/93 |
| 6,692,830 | B2 | 2/2004 | Argoitia et al. | 428/403 |
| 6,712,399 | B1 | 3/2004 | Drinkwater et al. | 283/111 |
| 6,729,656 | B2 | 5/2004 | Kubert et al. | 283/100 |
| 6,749,777 | B2 | 6/2004 | Argoitia et al. | 252/582 |
| 6,749,936 | B2 | 6/2004 | Argoitia et al. | 428/402 |
| 6,751,022 | B2 | 6/2004 | Phillips | 359/577 |
| 6,759,097 | B2 | 7/2004 | Phillips et al. | 427/510 |
| 6,761,959 | B1 | 7/2004 | Bonkowski et al. | 428/156 |
| 6,815,065 | B2 | 11/2004 | Argoitia et al. | 428/403 |
| 6,818,299 | B2 | 11/2004 | Phillips et al. | 428/403 |
| 6,838,166 | B2 | 1/2005 | Phillips et al. | 428/323 |
| 6,841,238 | B2 | 1/2005 | Argoitia et al. | 428/323 |
| 6,901,043 | B2 | 5/2005 | Zhang et al. | 369/275.5 |
| 6,902,807 | B1 | 6/2005 | Argoitia et al. | 428/403 |
| 6,987,590 | B2 | 1/2006 | Phillips et al. | 359/614 |
| 7,005,178 | B2 | 2/2006 | Bonkowski et al. | 426/156 |
| 7,029,525 | B1 | 4/2006 | Mehta | 106/31.6 |
| 7,047,883 | B2 | 5/2006 | Raksha et al. | 101/489 |
| 2002/0182383 | A1 | 12/2002 | Phillips et al. | 428/199 |
| 2003/0058491 | A1 | 3/2003 | Holmes et al. | 359/2 |
| 2003/0087070 | A1 | 5/2003 | Souparis | 283/91 |
| 2003/0134939 | A1 | 7/2003 | Vuarnoz et al. | 523/160 |
| 2003/0190473 | A1 | 10/2003 | Argoitia et al. | 428/403 |
| 2004/0009309 | A1 | 1/2004 | Raksha et al. | 427/598 |
| 2004/0028905 | A1 | 2/2004 | Phillips et al. | 428/404 |
| 2004/0051297 | A1 | 3/2004 | Raksha | |
| 2004/0052976 | A1 | 3/2004 | Buczek et al. | 427/598 |
| 2004/0094850 | A1 | 5/2004 | Bonkowski et al. | 264/1.34 |
| 2004/0100707 | A1 | 5/2004 | Kay et al. | 359/883 |
| 2004/0101676 | A1 | 5/2004 | Phillips et al. | 428/323 |
| 2004/0105963 | A1 | 6/2004 | Bonkowski et al. | 428/195.1 |
| 2004/0151827 | A1 | 8/2004 | Argoitia et al. | 427/7 |
| 2004/0166308 | A1 | 8/2004 | Raksha et al. | 428/329 |
| 2005/0037192 | A1 | 2/2005 | Argoitia et al. | 428/323 |
| 2005/0063067 | A1 | 3/2005 | Phillips et al. | 359/623 |

| | | | | |
|---|---|---|---|---|
| 2005/0106367 | A1 | 5/2005 | Raksha et al. | 428/199 |
| 2005/0123755 | A1 | 6/2005 | Argoitia et al. | 428/402 |
| 2005/0128543 | A1 | 6/2005 | Phillips et al. | 359/15 |
| 2005/0133584 | A1 | 6/2005 | Finnerty et al. | 235/375 |
| 2005/0189060 | A1 | 9/2005 | Huang et al. | 156/99 |
| 2006/0035080 | A1 | 2/2006 | Argoitia | 428/402 |
| 2006/0077496 | A1 | 4/2006 | Argoitia et al. | 359/2 |
| 2006/0081151 | A1 | 4/2006 | Raksha et al. | 106/31.65 |
| 2006/0097515 | A1 | 5/2006 | Raksha et al. | 283/91 |
| 2006/0194040 | A1 | 8/2006 | Raksha et al. | 428/323 |
| 2006/0198998 | A1 | 9/2006 | Raksha et al. | 428/323 |
| 2006/0263539 | A1 | 11/2006 | Argoitia | 427/547 |
| 2007/0058227 | A1 | 3/2007 | Raksha et al. | 359/2 |

FOREIGN PATENT DOCUMENTS

| | | | |
|---|---|---|---|
| DE | 1696245 | | 1/1972 |
| DE | 3932505 | | 4/1991 |
| DE | 4212290 | | 5/1993 |
| DE | 4343387 | | 6/1995 |
| DE | 19611383 | | 9/1997 |
| DE | 19731968 | | 1/1999 |
| DE | 19744953 | | 4/1999 |
| DE | 19639165 | | 10/2003 |
| EP | 0138194 | | 10/1984 |
| EP | 0185396 | | 12/1985 |
| EP | 0341002 | | 11/1989 |
| EP | 0420261 | | 4/1991 |
| EP | 0453131 | | 10/1991 |
| EP | 0556449 | | 8/1993 |
| EP | 0406667 | | 1/1995 |
| EP | 0660262 | | 1/1995 |
| EP | 0170439 | | 4/1995 |
| EP | 0710508 | | 5/1996 |
| EP | 0756945 | | 2/1997 |
| EP | 0395410 | | 8/1997 |
| EP | 0698256 | | 10/1997 |
| EP | 0741370 | | 5/1998 |
| EP | 0914261 | | 5/1999 |
| EP | 0953937 | | 11/1999 |
| EP | 0978373 | | 2/2000 |
| EP | 1174278 | | 1/2002 |
| EP | 1239307 | | 9/2002 |
| EP | 1 353 197 | | 10/2003 |
| EP | 1353197 | | 10/2003 |
| EP | 1 498 545 | A | 1/2005 |
| EP | 1516957 | | 3/2005 |
| EP | 1529653 | | 5/2005 |
| EP | 1669213 | | 6/2006 |
| EP | 1674282 | | 6/2006 |
| EP | 1719636 | | 11/2006 |
| EP | 1 741 757 | | 1/2007 |
| EP | 1745940 | | 1/2007 |
| EP | 1760118 | | 3/2007 |
| GB | 1107395 | | 3/1968 |
| GB | 1131038 | | 10/1968 |
| GB | 1546806 | * | 5/1979 |
| JP | 63172779 | | 7/1988 |
| JP | 11010771 | | 1/1999 |
| WO | WO88/07214 | | 9/1988 |
| WO | 93/23251 | | 11/1993 |
| WO | 95/17475 | | 1/1995 |
| WO | WO95/13569 | | 5/1995 |
| WO | 97/19820 | | 6/1997 |
| WO | 98/12583 | | 3/1998 |
| WO | WO00/08596 | | 2/2000 |
| WO | WO01/03945 | | 1/2001 |
| WO | WO 01/53113 | A | 7/2001 |
| WO | 02/00446 | | 1/2002 |
| WO | 02/04234 | | 1/2002 |
| WO | WO02/40599 | | 5/2002 |
| WO | WO02/40600 | | 5/2002 |
| WO | WO02/053677 | | 7/2002 |
| WO | WO02/090002 | | 11/2002 |
| WO | WO03/102084 | | 12/2003 |
| WO | WO2004/007096 | | 1/2004 |
| WO | 2004/024836 | | 3/2004 |
| WO | WO 2005/017048 | | 2/2005 |
| WO | WO2005/017048 | | 2/2005 |

OTHER PUBLICATIONS

Powell et al, (Ed.), Vapor Deposition, John Wiley & Sons, p. 132 (1996).

Van Renesse (Ed.), Optical Document Security, 2nd Ed., Artech House, 254, 349-369 (1997).

Prokes et al (Ed.), Novel Methods of Nanoscale Wire Formation, Mat. Research Soc. Bul., pp. 13-14 (Aug. 1999).

Lotz et al., Optical Layers on Large Area Plastic Films, Precision, Applied Films (Nov. 2001).

Argoitia et al, "Pigments Exhibiting Diffractive Effects", Soc. of Vac. Coaters, 45th Annual Tech. Conf. Proceed. (2002).

Argoitia et al, "The concept of printable holograms through the alignment of diffractive pigments", SPIE Conference on Document Security, Jan. 2004.

Himpsel et al, "Nanowires by Step Decoration", Mat. Research Soc. Bul., p. 20-24 (Aug. 1999).

Llewellyn, "Dovids: Functional Beauty—discussion about holography", Paper, Film, and Foil Converter, Aug. 2002.

Hardin, "Optical tricks designed to foil counterfeiters" OE Reports, No. 191, Nov. 1999.

Coombs et al, "Integration of contracting technologies into advanced optical security devices", SPIE Conference on Document Security, Jan. 2004.

Trub AG Switzerland, Security and Design Absolute Identity Latent Filter Image: LFI®, 2007, Trub AG, Hintere Bahnhofstrasse 12, CH-5001, Aarau http://www.trueb.ch/generator.aspx?tabindex=3&tabid=105&palias=en.

R. Domnick et al, "Influence of Nanosized Metal Clusters on the Generation of Strong Colors and Controlling of their Properties through Physical Vapor Deposition (PVD)" 49th Annual Technical Conference Proceedings (2006), Society of vacuum Coasters.

http://www.austriacard.at/main/EN/Products/IndustryAndGovernment/SecurityFeatures/index.html.

"Optical Thin-Film Security Devices", J.A. Dobrowolski, Optical Security Document, Rudolf Van Renesse, Artech House, 1998, pp. 289-328.

"Paper Based Document Security—a Review" Rudolf L. van Renesse, European Conference on Security and Detection, Apr. 28-30, 1997, Conference Publication No. 437, p. 75-80.

Diffractive Microstructures for Security Applications: M. T. Gale, Paul Scherrer Institute, Zurich, IEEE Conference Publication London 1991, pp. 205-209, Sep. 16-18, 1991.

Definition of "directly" from Webster's Third New International Dictionary, 1993, p. 641.

John M. McKiernan et al; "Luminescence and Laser Action of Coumarin Dyes Doped in Silicate and Aluminosilicate Glasses Prepared by Sol-Gel Technique," Journal of Inorganic and Organometallic Polymers, vol. 1, No. 1, 1991, pp. 87-103.

Jeffrey I. Zink et al, "Optical Probes and Properties of Aluminosilicate Glasses Prepared by the Sol-Gel Method," Polym. Mater. Sci. Eng., pp. 204-208 (1989).

"Security Enhancement of Holograms with Interference Coatings" by Phillips et al. Optical Security and Counterfeit Deterrence Techniques III Proceedings of SPIE vol. 3973 p. 304-316 (2000).

Don W. Tomkins, Kurz Hastings, "Transparent Overlays for Security Printing and Plastic ID Cards" pp. 1-8, Nov. 1997.

The Mearl Corporation Brochure for "Mearl Iridescent Film" Peekskill, NY.

J.A. Dobrowolski et al, "Optical Interference Coatings for Inhibiting of Counterfeiting" Optica Acta, 1973, vol. 20, No. 12, 925-037.

The R.D. Mathis Company Manual for "Thin Film Evaporation Source Reference" Long Beach, CA.

Minolta Manual for "Precise Color Communication, Color Control From Feeling to Instrumentation" pp. 18,20,22-23,46-49.

Frans Defilet, LGZ Landis & Gyr Zug Corporation, "Kinegrams 'Optical Variable Devices' (OVD's) for Banknotes, Security Documents and Plastic Cards" San Diego, Apr. 1-3, 1987.

S.P. McGrew, "Hologram Counterfeiting: Problems and Solutions" SPIE, vol. 1210 Optical Security and Anticounterfeiting Systems, 1990, pp. 66-76.

Rudolf L. van Renesse, "Security Design of Valuable Documents and Products" SPIE, vol. 2659, Jun. 1996, pp. 10-20.

Steve McGrew, "Countermeasures Against Hologram Counterfeiting" Internet site www.iea.com/nli/publications/countermeasures.htm, Jan. 6, 2000.
Roger W. Phillips, "Optically Variable Films, Pigments, and Inks" SPIE vol. 1323 Optical Thin Films III: New Developments, 1990, pp. 98-109.
Roger W. Phillips et al. "Optical Coatings for Document Security" Applied Optics, vol. 35, No. 28, Oct. 1, 1996 pp. 5529-5534.
J. Rolfe "Optically Variable Devices for use on Bank Notes" SPIE, vol. 1210 Optical Security and Anticounterfeiting Systems, pp. 14-19, 1990.
OVD Kinegram Cor "OVD Kinegram Management of Light to Provide Security" Internet site www.kiknegram.com.xhome.html, Dec. 17, 1999.
I.M. Boswarva et al., "Roll Coater System for the Production of Optically Variable Devices (OVD's) for Security Applications" Proceedings, 33rd Annual technical Conference, Society of Vacuum Coaters, pp. 103-109 (1990).
Halliday et al. "Fundamental of Physics, Sixth Edition", p. 662, Jul. 2000.

* cited by examiner

STAMPING A COATING OF CURED FIELD ALIGNED SPECIAL EFFECT FLAKES AND IMAGE FORMED THEREBY

CROSS-REFERENCE TO RELATED APPLICATIONS

The present application is a continuation-in-part of U.S. patent application Ser. No. 11/028,819 filed Jan. 4, 2005 now U.S. Pat. No. 7,300,695, which is a divisional application of U.S. patent application Ser. No. 10/243,111 filed on Sep. 13, 2002, now issued as U.S. Pat. No. 6,902,807 Jun. 7, 2005, the disclosures of which are hereby incorporated herein by reference.

The present application claims priority from application Ser. No. 60/807,103 filed Jul. 12, 2006, which is incorporated herein by reference.

FIELD OF THE INVENTION

This invention relates generally to optically variable pigments, films, devices, and images, and more particularly to aligning or orienting field alignable pigment flakes, such as during a painting or printing process, and subsequently transferring a region of the field aligned pigment flakes to an object or substrate to obtain a desired optical effect useful for example in security applications.

BACKGROUND OF THE INVENTION

The present invention also relates to field alignable pigments such as those that can be aligned or oriented in a magnetic or electric field, for example, flakes having an optically diffractive structure forming diffractive optically variable image devices ("DOVID"), such as orientable diffractive pigment flakes and stereograms, linegrams, graphic element-oriented devices, dot-oriented devices, and pixel-oriented devices, and oriented optically variable pigment flakes.

Optically variable pigments ("OVP's"™) are used in a wide variety of applications. They can be used in paint or ink, or mixed with plastic. Such paint or ink is used for decorative purposes or as an anti-counterfeiting measure on currency. One type of OVP uses a number of thin-film layers on a substrate that form an optical interference structure. Generally, a dielectric spacer layer is often formed on a reflector, and then a layer of optically absorbing material is formed on the spacer layer. Additional layers may be added for additional effects, such as adding additional spacer-absorber layer pairs. Alternatively optical stacks composed of (high-low-high)$^n$ or (low-high-low)$^n$ dielectric materials, or combinations of both, may be prepared.

U.S. Pat. No. 6,902,807 and U.S. Patent application publication numbers 2007/0058227, 2006/0263539, 2006/0097515, 2006/0081151, 2005/0106367, and 2004/0009309, disclose various embodiments related to the production and alignment of pigment flakes so as to provide images that can be utilized in security applications.

All of the aforementioned patents and applications are incorporated herein by reference, for all intents and purposes.

Although some pigment flakes suspended in a carrier vehicle can be aligned in electric fields, magnetically orientable flakes aligned in a magnetic field are generally more practicable. The term magnetic flakes used hereafter means flakes that can be aligned in a magnetic field. These flakes may or may not be magnetic themselves.

Optically variable devices are used in a wide variety of applications, both decorative and utilitarian, for example, such devices are used as security devices on commercial products. Optically variable devices can be made in numerous ways to achieve a variety of effects. Examples of optically variable devices include the holograms imprinted on credit cards and authentic software documentation, color-shifting images printed on banknotes, and enhancing the surface appearance of items such as motorcycle helmets and wheel covers.

Optically variable devices can be made as film or foil that is attached to an object, and can also be made using optically variable pigments. One type of optically variable pigment is commonly called a colour-shifting pigment because the apparent color of images appropriately printed with such pigments changes as the angle of view and/or illumination is tilted. A common example is the "20" printed with colour-shifting pigment in the lower right-hand corner of a U.S. twenty-dollar bill, which serves as an anti-counterfeiting device.

Some anti-counterfeiting devices are covert, while others are intended to be noticed. Unfortunately, some optically variable devices that are intended to be noticed are not widely known because the optically variable aspect of the device is not sufficiently dramatic. For example, the color shift of an image printed with color-shifting pigment might not be noticed under uniform fluorescent ceiling lights, but more noticeable in direct sunlight or under single-point illumination. This can make it easier for a counterfeiter to pass counterfeit notes without the optically variable feature because the recipient might not be aware of the optically variable feature, or because the counterfeit note might look substantially similar to the authentic note under certain conditions.

As need continues to design devices that are difficult to counterfeit and easy to authenticate, more interesting and useful devices become available.

For example, United States Patent application publication number 20060194040 in the name of Raksha et al. discloses a method and image formed by applying a first coating of magnetically alignable flakes; magnetically aligning the first coating of alignable flakes; curing the aligned flakes, and repeating the steps by applying a second coating of magnetically alignable flakes over the first cured aligned coating of flakes, aligning the second coating of flakes in a magnetic field and subsequently curing the second coating. This two-step coating, aligning and curing sequence allows first applied flakes to be magnetically aligned in a different orientation to the second applied flakes.

Although patent application 20060194040 provides a useful result, it would be desirous to achieve similar yet different images wherein fields within an image could be oriented differently, and wherein this two-step coating sequence was not required.

Furthermore, it would be useful to provide a method and resulting image wherein regions of an image formed by field aligning flakes could be utilized to form a mosaic wherein stamped-out aligned portions of an aligned image could be reoriented and applied to an object or substrate so as to form a desired pattern or image that differs from the originally aligned image.

It is an object of the present invention, to provide optically variable images wherein one or more regions of an image of field aligned flakes are stamped out, and are affixed to substrate in a preferred orientation.

SUMMARY OF THE INVENTION

In accordance with the invention there is provided a method of forming an image comprising the steps of:

coating a substrate with a pigment having field alignable flakes therein;

and applying a field to the field alignable flakes so as to align the flakes along applied field lines;

after performing step (b) curing the pigment; and stamping a region of the cured coated substrate with a stamp having a predetermined shape to yield a stamped transferable image formed of aligned flakes.

In accordance with an aspect of the invention a method of forming an image is provided comprising the steps of:

releasably coating a substrate with a pigment having field alignable flakes therein;

and applying a field to the field alignable flakes so as to align the flakes along applied field lines;

after performing step (b) curing the pigment;

stamping a region of the cured coating with a stamp having a predetermined shape to yield a stamped image formed of aligned flakes; and, applying the stamped image to a substrate or article.

In accordance with an aspect of this invention, an image is provided comprising a first region of flakes applied to a substrate after being aligned in a magnetic or electric field; and a second region of flakes applied to the same substrate after being aligned in a magnetic or electric field, wherein the first region of flakes on the substrate is oriented differently than the second region of flakes on the same substrate.

In accordance with another aspect of the invention an image is provided comprising a substrate having a first patch applied thereto, wherein the first patch includes aligned pigment flakes cured in a vehicle, wherein said aligned flakes form a discernible pattern, and a second region of aligned flakes cured in a vehicle applied thereto wherein the flakes within the first patch applied to the substrate are oriented differently than the second region of flakes on the same substrate, and wherein the first patch and the second distinct region of flakes are visible at the same time.

In accordance with another aspect of this invention an image is provided comprising a first region of flakes aligned in a magnetic or electric field wherein the first region of flakes were aligned and cured upon a first substrate; removed from the first substrate in the form of a patch of aligned flakes and transferred to a second object or substrate.

In accordance with another aspect of this invention a method of forming an image is provided comprising the steps of:

coating a release coating supported by a substrate with field alignable flakes; exposing the field alignable flakes to a magnetic or electric field to form field aligned flakes;

allowing the field aligned flakes to cure;

removing the field aligned flakes from the substrate while preserving their alignment; and, transferring the field aligned flakes to an object or another substrate in a predetermined orientation.

In accordance with another aspect of the invention the second stamped image is applied over at least a portion of the first stamped image.

BRIEF DESCRIPTION OF THE DRAWINGS

Exemplary embodiments of the invention will now be described in conjunction with the drawings in which.

DETAILED DESCRIPTION

In one particular embodiment described in more detail hereafter, the present invention utilizes magnetically aligned diffractive pigment flakes disposed in a magnetic field and subsequently cured to print images. Diffractive pigment flakes are generally small particles used in paints, inks, films, and plastics that provide variable perceived color, lightness, hue, and/or chroma, depending on the angle of view and angle of incident light. Some diffractive pigments, such as ones including Fabry-Perot-type interference structures, shift the observed color, as well as providing diffractive effects. Thin-film interference structures using dielectric layers can also be combined with a microstructure diffraction pattern. Some embodiments of this invention include a diffractive reflector layer in combination with a spacer layer and an absorber layer to form a flake having both diffraction and thin-film interference.

Depending on frequency, pigments with diffraction gratings separate light into spectral components, similar to a prism, so that the perceived color changes with viewing angle. It has been found that pigment flakes can be oriented with magnetic fields if the pigment flake includes a magnetic material. For the purposes of this application, "magnetic" materials can be ferro- or ferri-magnetic. Nickel, cobalt, iron, gadolinium, terbium, dysprosium, erbium, and their alloys and oxides, Fe/Si, Fe/Ni, Fe/Co, Fe/Ni/Mo, $SmCo_5$, $NdCo_5$, $Sm_2Co_{17}$, $Nd_2Fe_{14}B$, $TbFe_2$, $Fe_3O_4$, $NiFe_2O_4$, and $CoFe_2O_4$, are a few examples of magnetic materials. It is not necessary that the magnetic layer, or the magnetic material of the magnetic layer, be capable of being permanently magnetized, although it could be. In some embodiments, magnetic material capable of being permanently magnetized is included in a flake, but remains unmagnetized until after it is applied to form an image. In a further embodiment, flakes with permanent magnet material are applied to a substrate to form a visual image, and subsequently magnetized to form a magnetic image, in addition to the visual image. Some magnetic flakes tend to clump together if the remnant magnetization is too high prior to forming the image or mixing with a paint or ink vehicle.

Exemplary Flake Structures are described in United States patent publication number 20060263539 in the name of Argoitia, filed Aug. 2, 2006 incorporated herein by reference and various substrate materials are described as suitable for supporting diffractive pigment flakes in an ink vehicle.

Figure 1:
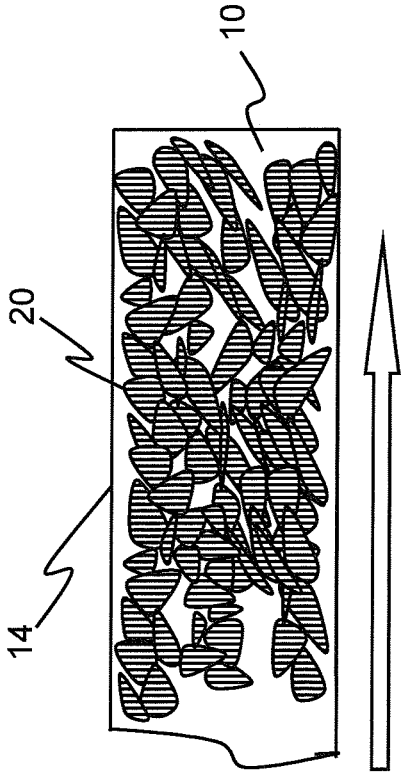
FIG. 1 is a plan view of a first ribbon-like substrate having varying shaped diffractive pigment flakes thereon magnetically aligned such that grooves within the diffractive flakes are parallel to one another orthogonal to the longitudinal axis of the ribbon.

Referring now to FIG. 1 a thin PET substrate 10 is shown having coated thereon a coating of groove oriented diffractive flakes 20 fixed in a carrier together forming a ribbon 14 that can be used in security applications. Each flake has a diffractive pattern of grooves shown in FIG. 1 to be aligned such that the grooves on respective flakes are parallel to one another. This groove alignment of the flakes 20 was achieved by coating the substrate with an ink having a clear carrier containing the diffractive flakes, and subsequently applying a magnetic field to the coating wherein the magnetic field lines are substantially parallel and orthogonal to the longitudinal axis of the substrate 10. When the field is applied, the flakes align themselves such that their grooves or lines follow the magnetic field lines. The coating is subsequently cured so that the flakes 20 are fixed in this preferred alignment. Depending upon the applied field, the flakes 20 may be flat lying coplanar with the substrate 10 or the flakes may be partially or full upstanding upon the substrate 10.

One limitation of forming a ribbon in this manner is that image formed on the substrate by the pattern of the flakes is dependent upon the shape of the applied field. Conveniently, this invention provides a method and image wherein regions of aligned fixed flakes can be combined in a mosaic like pattern of patches of aligned flakes to yield more complex and interesting images and security devices.

Prior to coating the substrate 10 with ink in FIG. 1, the substrate is coated with a release layer that allows the layer of ink to be removed as removable sheet or coated region consisting of cured ink having aligned flakes therein. This coating is suitable for hot-stamping or other similar methods of transfer.

Hot stamp transfer foils have been provided in conjunction with hot stamp machines to affix images onto various substrates such as paper, plastic film and even rigid substrates. Hot stamping is a dry process. One commercially available machine for hot stamping images onto substrates is the Malahide E4-PK produced by Malahide Design and Manufacturing Inc. Machines of this type are shown and described on the Internet at www.hotstamping.com. Simplistically, in a hot-stamping process, a die is attached to the heated plate which is pressed against a load roll of hot stamping foil to affix the foil to an article or substrate. A roll on transfer process could also be used in this invention. In this case, the article substrate and the adhesive (UV or heat activated) is brought together at a nip to effect the transfer of the hot stamp layer to the article substrate.

An image is typically formed by utilizing a metal or silicone rubber die into which the desired image has been cut. This die is placed in the hot stamping machine and is used to press the image into hot stamp foil utilizing a combination of heat and pressure. The back side of the foil is generally coated with a dry heat activated, thermo set adhesive, for example an acrylate based adhesive. Upon the application of heat, the adhesive becomes tacky in regions of the heated image and adheres to the paper or plastic substrate. Hot stamping is described or mentioned in the U.S. Pat. Nos. 5,002,312, 5,059,245, 5,135,812, 5,171,363, 5,186,787, 5,279,657 and 7,005,178, in the name of Roger Phillips of Flex Products Inc. of Santa Rosa Ca.

Figure 2B:
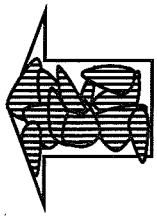
FIG. 2*b* is a plan view of a stamped-out foil patch of aligned flakes in the shape of the arrow stamped from the first ribbon-like substrate shown in FIG. 1 with the die shown in FIG. 2*a*.
Figure 2A:
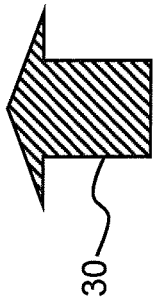
FIG. 2*a* is a plan view of a stamping die in the form of an arrow.

FIG. 2*a* is a plan view of a first stamping die 30 in accordance with this invention, in the form of an arrow that is used to produce the stamped coating shown in FIG. 2*b*. As the ribbon 14 is moved through a stamping station, the stamping die 30 stamps the coating in the shape of the arrow shown for transfer to a substrate. The arrow can be oriented as shown, wherein the grooves of the flakes are aligned in the direction of the arrow, or alternatively, other orientations could have been used.

Therefore stamping die 30 after stamping the ribbon 14 produces a patch of aligned flakes in the form of an arrow with diffractive grooves oriented up-down as the ribbon 14 moves through the stamping apparatus. In a preferred embodiment of the invention, this invention, this is a first step in a hot-stamping process. In the presence of heat and pressure, this arrow shaped patch is hot-stamped to a substrate.

Figure 3:
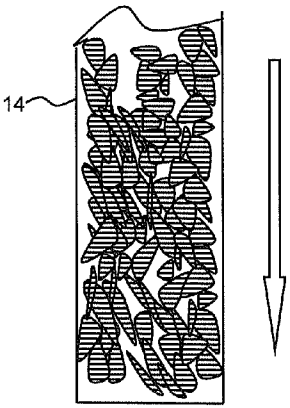
FIG. 3 is a plan view of the first ribbon-like substrate oriented 90 degrees to the orientation of the substrate shown in FIG. 1 relative to the second stamping die conveniently having its stamped out region with the flakes oriented 90 degrees to the stamped out region of FIG. 2*b*.

Referring now to FIG. 3, at a second stamping station the same ribbon 14 is shown moving under the stamping die 40 such that the aligned flakes are oriented orthogonally with respect to the cut-out arrow in the die 40. This allows the single ribbon 14 with flakes oriented in a particular orientation to provide stamped areas with flakes having their grooves oriented at different angles simply by changing the angle in which the ribbon is fed into the stamping equipment. This different orientation of two regions of otherwise essentially same flakes provides different visual effects from the two regions in lighting conditions other than normal incidence and is also useful as a means of authentication of an article or product the composite images are applied to.

Figure 4A:
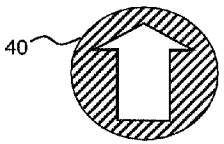
FIG. 4*a* is a plan view of a circular stamping dye having an arrow-shaped opening in a center thereof.
Figure 4B:
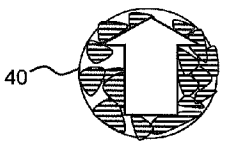
FIG. 4*b* is a circular stamped region stamped from the first ribbon-like substrate with the circular stamping die shown in FIG. 4*a*.
Figure 4C:
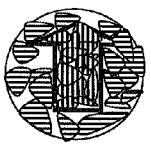
FIG. 4*c* is a plan view of the final image having the stamped arrow foil placed on the stamped circular region, wherein the orientation of the diffractive grating in the diffractive pigment flakes forming the arrow foil are orthogonal to the diffractive structures in the circular stamped foil region.

As is illustrated in FIG. 4*b*, the stamping die 40 after stamping the ribbon 14 produces a patch of aligned flakes in the form of a circular area surrounding an arrow with the grooves oriented left to right. The ribbon 14 stamped by the die 40 may be the same or a different ribbon as 14 with the grooves of the diffractive flakes oriented in the same way as in ribbon 14. Therefore the same ribbon can be used for both stamping stations, or a different ribbon having flakes oriented in a same manner can be used.

In the embodiments described heretofore, diffractive flakes having grooves or lines therein have been used in such a manner as to be aligned in a particular direction with respect to the substrate. Then regions of the cured coating were stamped out and applied via a hot stamp or other process to a different substrate. Of course other suitable forms of adhesion between the stamped diffractive substrate and the object or substrate to which the stamped region is to be joined with can be utilized. The direction of the dispersion of light in a diffractive pigment is a function of the frequency of the gratings. For low frequencies the observer will get only a dark-bright contrast instead of a change of hue. Frequency can be changed depending of the dynamic effect desired.

In an alternative embodiment non diffractive planar flakes can be used wherein the flakes are field aligned upon a release layer of a substrate and cured. These aligned non-diffractive flakes can then be removed from the substrate as a cured region of aligned flakes and reapplied to a different substrate or object, in a same manner as has been described. This is particularly interesting when out of plane alignment is utilized by applying magnetic fields that result in upstanding flakes. It is also possible to provide out of plane diffractive flakes and to subsequently stamp out a cured region of these flakes for reapplication to a different substrate.

Figure 5:
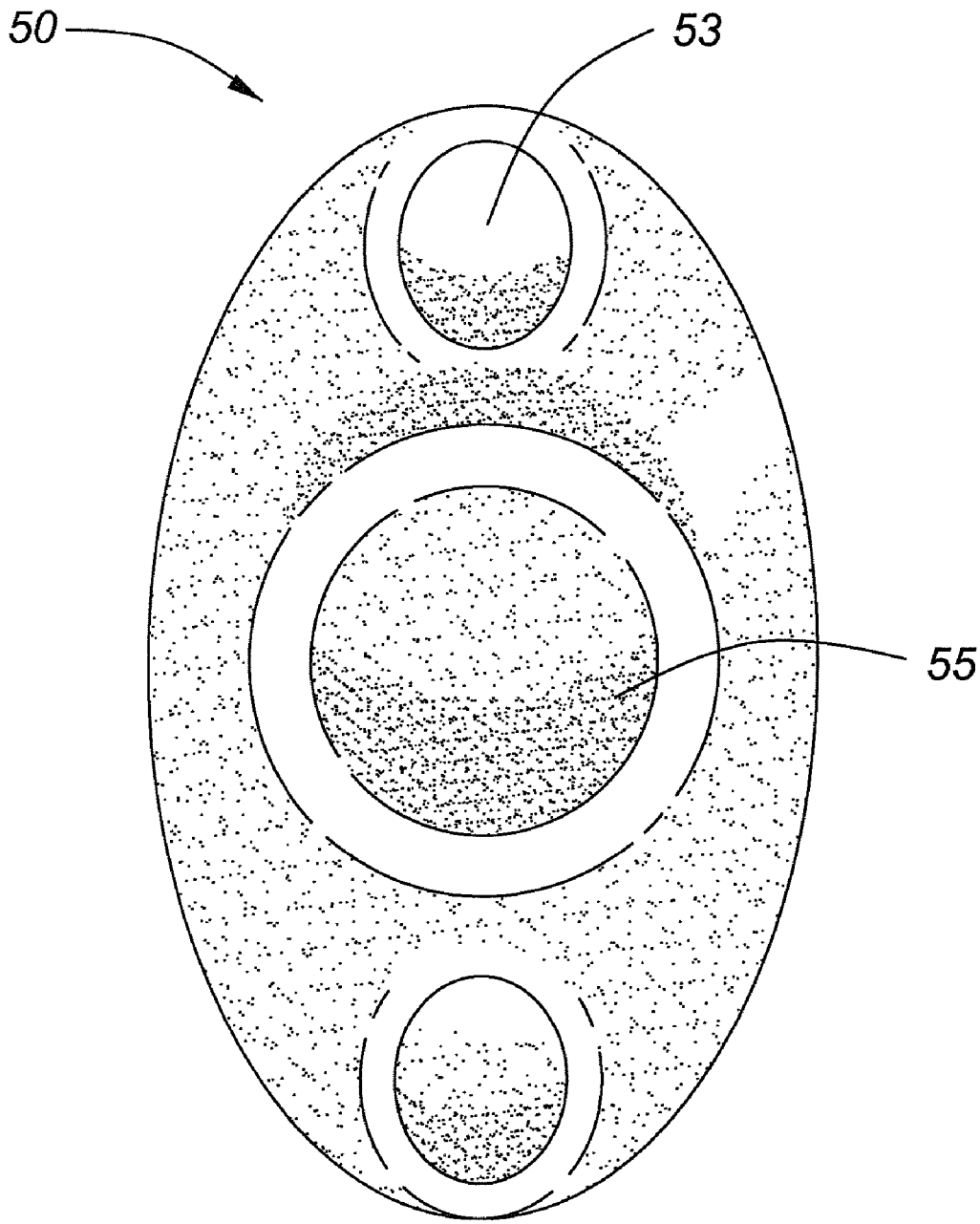
FIG. 5 is a photograph of a region of magnetically aligned flakes aligned to yield a 3D image wherein some of the flakes are out of plane from the substrate.

Turning now to FIG. 5 an image 50 having out-of-plane upstanding flakes is shown where some of the flakes 53 lie in a plane parallel to the substrate and wherein other of the flakes 55 are upstanding on the substrate nearly orthogonal to it.

Figure 6:
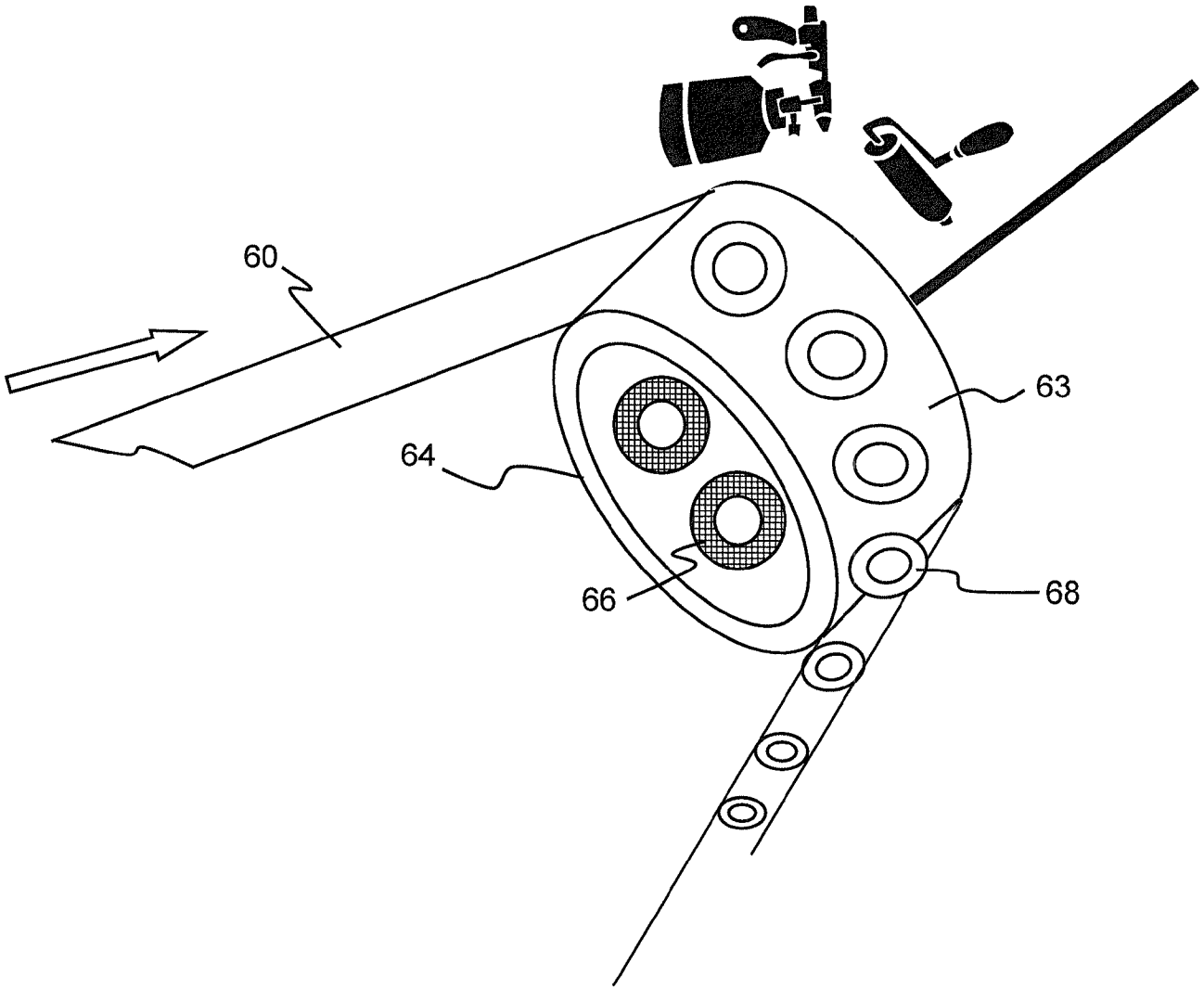
FIG. 6 is an illustration of a painting or printing station wherein a moving ribbon with a releasable hard coat is coated with ink or paint having magnetic flakes therein and wherein the ribbon passes over a cylinder having magnets therein which align magnetic flakes in a desired orientation.

FIG. 6 shows a configuration wherein a ribbon 60 comprising a releasable hard coat is painted with a magnetic pigment 63 as it is carried over a rotating cylinder 64 having circular magnets 66 therein. The flakes within the magnetic pigment 63 are aligned by the field generated from the magnets within the cylinder and the resulting 3D images 68 formed in the pigment are cured. The cured 3D images 68 are then applied to other objects or substrates after being stamped and released from the ribbon substrate.

In summary, this invention provides a novel and inventive way in which to apply magnetically aligned flakes from a substrate onto a substrate or article wherein the orientation of the aligned flakes can be changed upon transfer. Of course numerous other embodiments may be envisaged without departing from the spirit and scope of the invention.

What is claimed is:

1. A method of forming an image comprising the steps of:

a) coating a first substrate with a pigment coating having field alignable flakes in a carrier; wherein the field alignable flakes are diffractive flakes having a diffractive pattern of grooves therein;

b) applying a magnetic or electric field to the pigment coating so as to align the flakes therewithin along field lines of the magnetic or electric field so that the grooves are parallel to the field lines;

c) after performing step (b) curing the pigment coating;

d) stamping a first region of the cured coated first substrate with a stamp having a first shape to yield a first stamped transferable image formed of aligned flakes;

e) stamping a second region of the first substrate or of a second substrate to yield a second stamped transferable image formed of aligned flakes wherein the aligned flakes have grooves; and, f) transferring the first and second stamped transferable images to a third substrate or object, wherein the grooves of the aligned flakes in the first stamped transferable image are oriented differently than the grooves of the aligned flakes in the second stamped transferable image providing different visual effects from the first and second stamped transferable images in lighting conditions other than normal incidence.

2. A method as defined in claim 1 wherein the first stamped transferable image is transferred to the third substrate or object while it is being stamped.

3. A method as defined in claim 1 wherein the first stamped transferable image is transferred to the third substrate or object by hot stamping.

4. A method as defined in claim 1 wherein the first stamped transferable image is adhesively transferred to the object.

5. A method as defined in claim 1 wherein the first substrate has a release coating thereon so that the stamped image can be released from the release coating.

6. A method as defined in claim 1 wherein step (d) is performed a plurality of times so as to yield a plurality of stamped images formed of aligned flakes.

7. A method as defined in claim 6 wherein at least some of the applied stamped images are disposed next to each other on the third substrate or object such that their diffractive patterns are not parallel.

8. A method as defined in claim 6, wherein the stamped images are subsequently transferred to the third substrate or object and wherein one stamped image is applied at least partially over another.

9. A method as defined in claim 1 wherein the field alignable flakes are color-shifting diffractive flakes.

10. A method as defined in claim 1 wherein the first and second stamped transferable images have different shapes or sizes.

11. A method of forming an image comprising the steps of:

a) coating a first substrate with a pigment coating having field alignable flakes in a carrier therein;

b) applying a magnetic or electric field to the pigment coating so as to align the flakes therewithin along field lines of the magnetic or electric field;

c) after performing step (b) curing the pigment coating;

d) stamping a first region of the cured coated first substrate with a stamp having a first shape to yield a first stamped transferable image formed of aligned flakes;

e) stamping a second region of the first substrate or of a second substrate to yield a second stamped transferable image formed of aligned flakes; and, f) transferring the first and second stamped transferable images to a third substrate or object, wherein the aligned flakes in the first stamped transferable image are oriented differently than the aligned flakes in the second stamped transferable image providing different visual effects from the first and second stamped transferable images in lighting conditions other than normal incidence;

wherein step (b) results in the flakes being aligned at an angle to the first substrate so that at least some of the flakes are substantially upstanding with their faces orthogonal to the substrate.

* * * * *